US005280496A

United States Patent [19]

Schlecht et al.

[11] Patent Number: 5,280,496

[45] Date of Patent: Jan. 18, 1994

[54] INDUCTION FURNACE WITH COOLED CRUCIBLE

[76] Inventors: Francois Schlecht, 31, avenue de la Monta, 38120 St. Egreve; Roland Ernst, 8, rue Pasteur, 38610 Gieres; Christian Garnier, 20, Allee Bachelard, 38320 Eybens, all of France

[21] Appl. No.: 735,531

[22] Filed: Jul. 26, 1991

[30] Foreign Application Priority Data

Jul. 26, 1990 [FR] France ..... 90 09865

[51] Int. Cl.[5] ..... H05B 6/22

[52] U.S. Cl. ..... 373/158; 373/138; 373/151; 373/155; 373/156; 75/10.14; 75/10.15

[58] Field of Search ..... 373/152, 153, 156, 154, 373/157, 158, 159, 144, 146, 145, 149, 76, 77, 138; 219/10.49 R; 75/10.15, 10.14

[56] References Cited

U.S. PATENT DOCUMENTS

| | | | |
|---|---|---|---|
| 1,943,802 | 1/1934 | Northrup | 373/152 |
| 3,461,215 | 8/1969 | Reboux | 373/158 |
| 3,786,163 | 1/1974 | Kohama | 373/158 |
| 3,867,563 | 2/1975 | Laflin | 373/138 |
| 3,913,005 | 10/1975 | Cook | 373/146 |
| 4,058,668 | 11/1977 | Clites | 373/76 |
| 4,139,722 | 2/1979 | Karlsson | 373/138 |
| 4,201,882 | 5/1980 | Kolotilo et al. | 373/156 |
| 4,419,755 | 12/1983 | Ohmori et al. | 373/145 |
| 4,432,093 | 2/1984 | Reboux | 373/157 |
| 4,437,885 | 3/1984 | Bolze | 75/10 R |
| 4,446,562 | 5/1984 | Friedmann et al. | 373/149 |
| 4,471,488 | 9/1984 | Reboux | 373/153 |
| 4,622,679 | 11/1986 | Voss | 373/152 |
| 4,723,996 | 2/1988 | Brunet et al. | 373/138 |
| 4,873,698 | 10/1989 | Boen | 373/156 |
| 5,090,022 | 2/1992 | Mortimer | 373/156 |

*Primary Examiner*—Bruce A. Reynolds
*Assistant Examiner*—Tu Hoang
*Attorney, Agent, or Firm*—Lowe, Price, LeBlanc & Becker

[57] ABSTRACT

An induction furnace includes a crucible having a plurality of cooled metallic segments (6A, 6B) electrically insulated from each other and an electromagnetic induction coil (5) arranged around the crucible, wherein the electromagnetic induction coil is energized with low frequency electric current. Each of the metallic segments forming the crucible wall is made of a relatively thin sheet, and a cooling pipe is provided on each segment. The cooling pipes (22) are welded or brazed to an outer surface of each corresponding segment. A refrigerant flows through each pipe in order to evacuate heat from the corresponding segment. The furnace further includes a magnetic core (8) disposed above and near the top surface of the charge placed in the crucible. This magnetic core provides local narrowing of the magnetic field lines, causing centripetal motion of the melted part of charge located at or near the top surface of the charge. A second electromagnetic coil arranged at an exhaust port in the crucible controls flow of melted charge through the exhaust port.

10 Claims, 2 Drawing Sheets

INDUCTION FURNACE WITH COOLED CRUCIBLE

TECHNICAL FIELD

The present invention relates generally to induction furnaces having a cold crucible.

BACKGROUND ART

Induction furnaces having a crucible for receiving metallic material to be melted, hereinafter called a 'charge', are well known. Such a crucible is generally called a 'cold crucible' because it is not substantially heated by the induction device, and it is permanently cooled by a cooling device. In such furnaces, it is also well known to cause levitation of the charge by using electromagnetic confinement phenomenon, resulting in a separation of the charge to be melted from the inner crucible walls.

It is common practice to make the crucible from a plurality of metal segments, electrically isolated from each other to reduce electromagnetic losses in the segments. Collectively, the segments form the metallic wall of the crucible.

It is also well known to form such a crucible in a generally cylindrical shape. The bottom part of this shape is hemispheric or conical and includes a central hole for the release of the melted charge.

A major preoccupation in the design and operation of such furnaces is avoidance of excessive heating of the crucible wall. The division of the crucible wall into a plurality of segments, electrically insulated from each other results in a reduction of the induction effects on the wall and limits heating of the wall. However, it is not possible to completely suppress such heating. Furthermore, the charge melting in the crucible transmits a certain amount of heat to the crucible wall. Therefore, it is necessary to substantially cool the segments forming the crucible wall. Generally, this cooling is carried out by forming the segments of the crucible wall of a metal, such as copper, which conducts heat, and by providing holes in the segments. These holes accommodate pipes extending parallel to the longitudinal axis of the crucible, and containing a cooling fluid such as water.

Generally, the segments forming the crucible are relatively thick because they have to be large enough to contain the diameter of the cooling pipes provided inside the segments. As the segments necessarily have a thickness greater than the penetration depth of the magnetic field generated by the induction system, it has not been possible to substantially avoid magnetic induction effects in these segments. Thus, in order to limit induction effects, the lateral dimensions of the crucible, i.e., its diameter, have been very limited. The width of the segments could not be made less than a determined value because they must include at least one longitudinal hole for a cooling pipe. Thus, design flexibility has been seriously curtailed.

For these reasons, known furnaces must use magnetic induction means operated at intermediate frequencies, i.e. greater than about 400 Hz. Such furnaces have other drawbacks such as high manufacturing costs, which increase with the number of segments used. Moreover, input and output pipes for the refrigerant must be provided for each segment. It is also necessary to provide the fluid connection of these pipes, as well as the electrical insulation separating the segments from each other.

Such a crucible is therefore difficult to produce and its cost is relatively high.

Another drawback is that magnetic induction coils operating at intermediate frequency allow only relatively low currents. Therefore, the voltage across these coil terminals is relatively high, greater than 80 volts, for example. It is therefore necessary to take precautions with such systems to avoid risk of electrocution and to limit electric arcing.

Yet an additional drawback is that in order to supply an intermediate frequency electric current to such a magnetic induction system, it is necessary to provide an intermediate frequency electric supply transformer. Such a supply system is relatively expensive, particularly if it delivers high levels of electric energy. It has not been possible heretofore to build an induction furnace having a cooled wall, with a capacity to contain a volume of charge greater than about 5000 $cm^3$. Generally, the inner diameter of such a crucible is never greater than 150 mm.

In such prior art furnaces, a problem arises concerning the mixing of metal melted in the crucible. This mixing is often not satisfactory and this has heretofore limited furnace capacity.

DISCLOSURE OF THE INVENTION

It is an object of the present invention to provide an induction furnace with a cooled wall having a relatively high capacity. The furnace uses electromagnetic induction means having a simpler design than those existing in prior art induction furnaces.

It is a further object of the present invention to provide a furnace in which the electromagnetic induction means has very high electric efficiency.

It is another object of the present invention to provide a furnace in which the crucible has a simpler design than those existing in similar prior art furnaces, the furnace of present invention having as high an efficiency as that of prior art furnaces. The furnace of the present invention maintains an outer wall temperature at least as low as that of similar prior art furnaces.

It is still another object of the present invention to provide a furnace having electromagnetic induction means operating at a relatively low potential level, less than 40 volts, for example, in order to ensure a high degree of system safety, eliminating the need for complicated protection means.

It is a further object of the present invention to provide a furnace in which it is possible to obtain, in a controlled and effective manner, a mixing effect, for a furnace having a capacity greater than 5000 $cm^3$, for example.

In accordance with the present invention an induction furnace comprises a crucible having a plurality of metallic segments, electrically insulated from each other, each of the metallic segments having a predetermined width and being formed of a metal sheet being relatively thin as compared to the predetermined width of the segment. A cooling means is provided on each segment. The cooling means comprises of pipe connected to the outer surface of each segment. Refrigerant flowing through the pipe evacuates heat from the corresponding metallic segment. An electromagnetic induction means comprising a plurality of windings arranged around the crucible to heat charge placed within the crucible.

In accordance with another embodiment of the present invention, an induction furnace comprises a crucible having a plurality of metallic segments, electrically insulated from each other. Each of the metallic segments has a predetermined width and is formed from a metallic sheet being relatively thin as compared to the predetermined width of the metallic segment. A cooling means is provided on the outer surface of each metallic segment. An electromagnetic induction means is arranged around the crucible creating a magnetic field when energized. A magnetic core disposed above and near the top surface of a charge of metal placed within the crucible. The magnetic core provides a local narrowing of the magnetic field lines, thus causing centripetal motion of a melted part of the charge located at or near the top surface of the total charge within the crucible.

In yet another embodiment, the induction furnace comprises a crucible having a plurality of metallic segments electrically insulated from each other. The crucible is open at the top portion to receive charge and substantially closed at the bottom portion to contain the charge. Cooling means are provided on an outer surface of each of the metallic segments. Electromagnetic induction means are arranged around the crucible and are energized by high intensity, low frequency electric current. An exhaust pipe is located at the bottom of the crucible. A second electromagnetic induction means is arranged around and near the exhaust pipe and energized by an intermediate frequency electric current to control the flow of melted charge through the exhaust pipe.

These and other objects features and advantages of the present invention are described in detail in the following description taken in conjunction with the accompanying drawings.

BEST MODE FOR CARRYING OUT THE INVENTION

Figure 1:
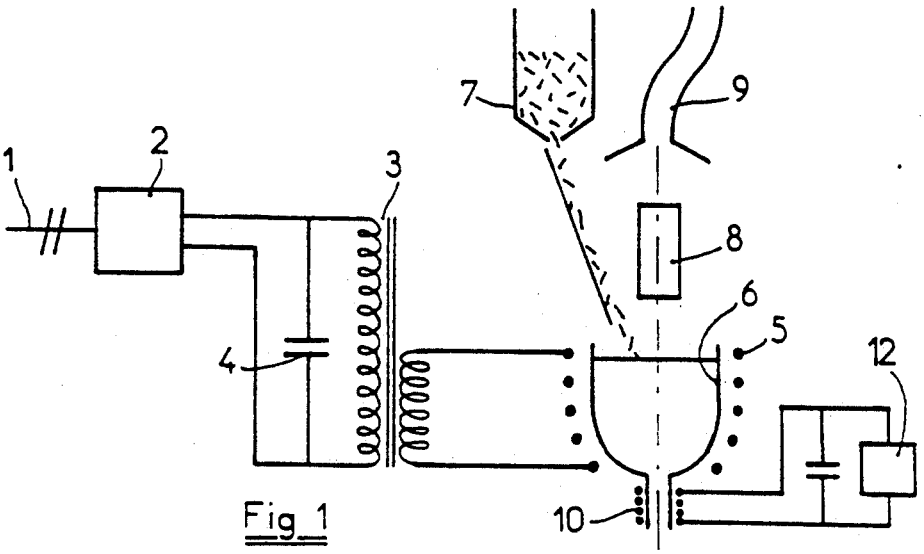
FIG. 1 is a diagram of a furnace system according to the present invention.

A preferred embodiment of a furnace according to the present invention is schematically shown in FIG. 1. A power supply line 1 from the two-phase 380 V mains supplies at least a 250 A current to the system. Line 1 feeds an intensity modulation power device 2 of a conventional design which supplies the primary winding of a monophase adaptation transformer 3. This transformer outputs at its secondary winding an electric current of 4000 A with a voltage across the secondary winding not greater than 100 V. An impedance corrector condenser or condenser battery 4 is generally provided in parallel on the input terminals of the primary winding of the transformer 3. The secondary winding of transformer 3 directly supplies an exciting winding 5 arranged around crucible 6 of the furnace.

The crucible is a cooled wall type and is described with reference to FIG. 2. The furnace includes a material feeding means 7 which supplies material (the charge) according to a desired rate or amount into the crucible. This material can be, for example, scrap metal chips. The furnace also has a magnetic core 8 arranged above the crucible 6. The furnace further includes an exhaust device 9 provided with a filter able to exhaust the furnace vapors and emanations during its operation. The crucible 6 is provided with a lower port (35 in FIG. 3) permitting downward flow of the melted metal into a suitable receptacle 11. Means for obtaining controlled opening or closing of the exhaust port of the crucible, includes a winding 10 disposes around the port. This winding is supplied by another generator 12 applying alternating current.

Transformer 3 is directly supplied with an electric current from commercial mains, i.e. with electric current at a relatively low frequency, for example 50 or 60 Hz. The other generator 12 which is used to supply the winding 10, supplies an electric current at substantially higher frequency (an intermediate frequency), such as 400 to 1000 Hz. As these two electric AC supplies can be easily arranged without significant parasitic couplings therebetween, control and regulation can be easily carried out. The respective frequencies differ enough so that electromagnetic couplings between them are negligible.

The electric current supplying winding 5 is very high, 4000 A for example. The main power generation means of the furnace (devices 2, 3, 4) is able to provide such a current relatively easily because the required current has the same frequency as that of the commercial mains (line 1), that is 50 or 60 Hz. Such a device does not require complicated and expensive high or intermediate frequency generators. The other generator 12 supplies a much lower output power so that its operation does not cause significant problems even though it supplies an intermediate frequency, significantly greater than that of the commercial mains.

Figure 2:
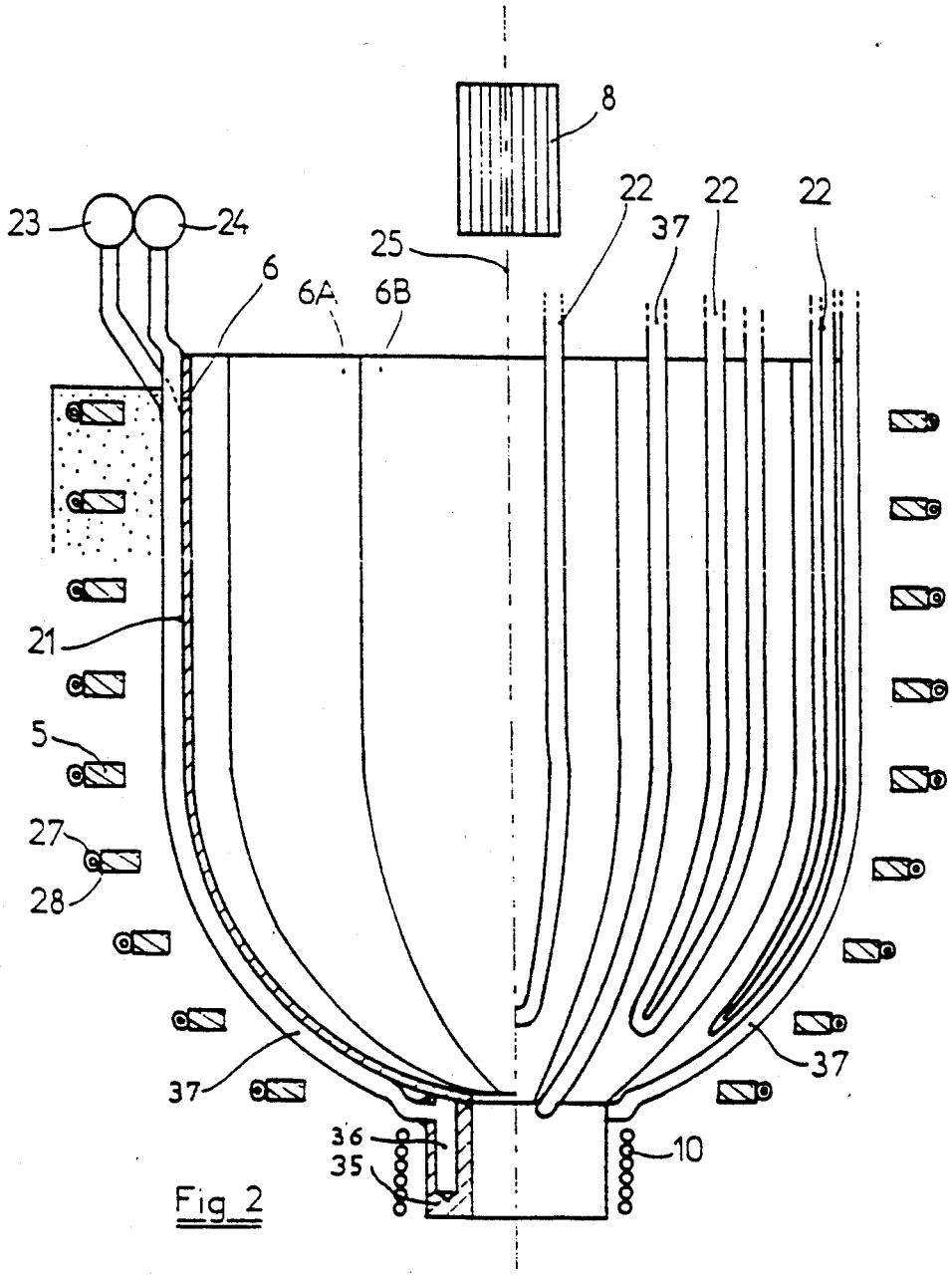
FIG. 2 is a partial cross sectional view showing an embodiment of a furnace according to the present invention.

FIG. 2 is a cross sectional view of the furnace according to the present invention. Some elements described with reference to FIG. 1, i.e., inductor winding 5, intermediate frequency inductor winding 10 and magnetic core 8 are shown. One of the essential parts of a furnace of this type is the cold wall crucible 6. The crucible has a conventional shape with an upper cylindrical portion and a spherical or conical bottom at the lowest part with an opening 35 used for the release of the melted metal contained in the crucible.

This crucible is characterized in that it has a relatively thin metallic wall, from 1.5 to 4 mm for example. This wall is punched out and stamped from a metal sheet. The crucible wall is not made with only one piece but is composed of a number of segments 6A, 6B, etc., longitudinally extending and electrically insulated from each other. This type of segmented crucible wall structure is well known in the prior art. According to the invention, the number of segments forming the wall of the crucible 6 may be relatively low, 4 to 12, for example.

All the segments forming the wall of the crucible 6 are held by a holding case (not shown) made of an electric insulation material composed of a conventional refractory material, for example concrete. This casing must withstand the temperature of the wall of the crucible, and also must withstand mechanical stresses and thermal shock. Such a casing is known in the prior art.

The different segments forming the wall of crucible 6 are made of an electrical and thermal conducting metal, preferably copper. Other metals can also be used; the choice of which essentially depends upon the physical and chemical features of the charge to be melted in the crucible.

On the outward surface 20 of each segment forming the wall of crucible 6, a metallic pipe 22 is welded or brazed (21). The largest part of the pipe substantially extends in a direction parallel to the longitudinally vertical axis 22 of the crucible. There is a pipe 22 for each of the segments 6A, 6B, etc. Each pipe 22 has a U-shape at its upper end and is connected with a cooling water supply pipe 23 and with a cooling water exhaust pipe 24, respectively. Preferably, pipes 22 are made of the same material as the wall, generally copper. The pipe 22 is about 10 mm in diameter and about 1 mm in thickness. This kind of copper pipe is readily available.

Inductor winding 5 is composed of a relatively small number of windings, 5 to 20, for example. Each winding has a rectangular cross section, the largest side of which is orthogonally disposed with respect to the vertical axis of the crucible. A pipe 27 is welded or brazed to each winding of inductor 5 at its outward wall 28. The pipe 27 runs along the outer face of the windings forming the inductor 5. This pipe has a relatively small diameter, preferably substantially equal to the thickness of the windings. The winding cross sectional area is designed to let the maximum current intensity supplied by the transformer 3 pass through the winding, 4000 A, for example. The inductor winding 5 can be made of copper and pipe 27 is also preferably made of copper to be more easily brazed to the winding. Coolant water is caused to flow through the pipe 27 to cool the whole inductor winding 5. The distance between the different windings forming the inductor winding 5 and the wall of the crucible 6 is relatively constant and therefore, the diameter of the different windings is constant at the upper section of the crucible (which is cylindrical) and goes on shortening at the lower portion of the crucible (which is spherical or conical), as shown in FIG. 2.

A magnetic core 8 is made of a laminated magnetic material with glass sheets in between and vertically oriented, for example. Such laminated material is conventionally used for magnetic circuits operating at low frequency, particularly at 50 or 60 Hz. At low frequency, a magnetic core made of laminated material is very efficient for channeling the field lines produced by inductor winding 5. For operation at such frequencies, it is easy to form a magnetic core having high effectiveness and being subject to very little heating despite the very high intensity of the magnetic field generated around the furnace. The magnetic core 8 has the shape of a cylinder, the vertical axis of which merges with the longitudinal axis 25 of crucible 6. The vertical position of the magnetic core can be adjusted by means of a suitable adjustable support means (not shown).

Figure 3:
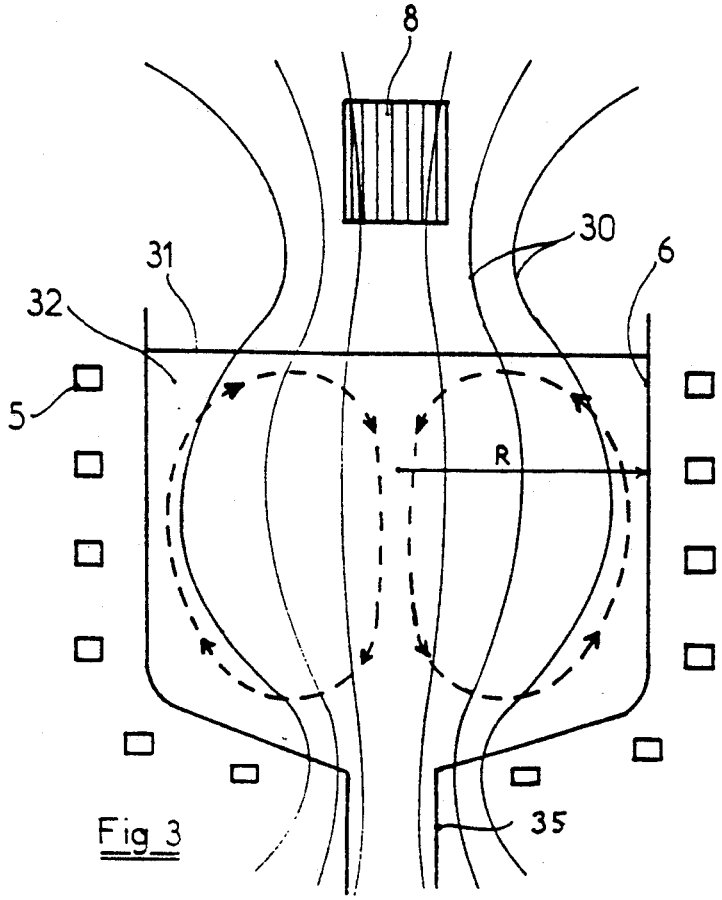
FIG. 3 is a diagram showing the shape of the field lines appearing in a furnace according to the present invention.

As shown in FIG. 3, magnetic core 8 causes a narrowing of the field lines 30 at the upper surface 31 of the melting charge 32 inside the crucible 6. This narrowing of the field lines causes a centripetal motion of the melting material at or near the surface 31 of the melted material, resulting in a mixing of the melting charge in a reverse direction to the natural mixing direction occurring without such a core. This new mixing is illustrated by dotted lines with arrows showing the flow direction of the melted metal. This centripetal motion at the upper surface of the melting charge allows the not-yet-completely melted materials floating at the surface to be driven to the center and to be then pulled into the charge. Without such a core, the material at the melting charge surface tends to move in a centrifugal manner and the non-melted materials floating at this surface stay at this surface and accumulate near the periphery of the charge, in a detrimental manner. If inductor winding 5 is supplied with an intermediate frequency current, efficient magnetic core use cannot be realized because the magnetic core would be necessarily made of a ferrite material. Such material would heat substantially and would not be sufficiently efficient because of the effects caused by the energies from inductor winding 5.

The induction furnace according to this invention further includes a particular device functioning as a control valve for controlling the exit of the melted charge from the interior of the crucible. This device includes an upright cylindrical wall forming an exhaust duct 35 (exhaust port) disposed under crucible 6. This duct has a relatively small diameter, about 30 mm, for example. Duct 35 is cooled by means of circulating water in holes 36 in the duct. The water is provided by coolant water delivery pipes 37 and exhaust pipes 38.

An intermediate frequency can be used to energize the inductor winding 10 because its diameter is relatively small. The exciting coil 18 is an intermediate frequency winding which generates an electromagnetic induction field at the center of the duct 35, resulting in the melting of the material contained into this pipe, allowing downward flow and exhaust of the melted charge. If the supply of the inductor winding 10 is de-energized, the material quickly solidifies again within duct 31. This results in obturation of duct 35. Therefore, opening or closing of exhaust port 35 can be controlled as desired by controlling winding 10.

By using a furnace designed as previously described with thin walls and external cooling pipes, it is possible to operate a crucible having a relatively large diameter, such as 300 to 400 mm. The use of an inductor winding supplied with a low frequency current is critical to the operation of a crucible of such a diameter. With the use of a low frequency, such as 50 or 60 Hz permitted by the thin walls of the crucible, a maximum effectiveness, i.e., the energetic yield of the furnace, of about 30 can be obtained. This is expressed using a ratio A of the crucible radius R to the skin thickness E (i.e., $A=R/E=30$). Consequently, a crucible having a large diameter can be efficiently operated at low energization potential with this invention.

Although a number of arrangements of the invention have been mentioned by way of example, it is not intended that the invention be limited thereto. Accordingly, the invention should be considered to include any and all configurations, modifications, variations, combinations, or equivalent arrangements falling within the scope of the annexed claims.

We claim:

1. An induction furnace comprising:

(a) a crucible having a plurality of metallic segments, electrically insulated from each other, each said metallic segment having a predetermined width and being formed of a metal sheet being relatively thin as compared to said predetermined width of said metallic segment;

(b) cooling means provided along each metallic segment, said cooling means comprising a pipe connected to and arrange longitudinally along an outer surface of each corresponding metallic segment, each said pipe containing a refrigerant flowing therethrough to evacuate heat from each said corresponding metallic segment; and (c) electromagnetic induction means comprising a plurality of windings arranged around said crucible.

2. The induction furnace according to claim 1, wherein each said pipe is welded or brazed to an outer surface of each said corresponding metallic segment.

3. The induction furnace according to claim 1, wherein said metallic segments have a thickness between 1.5 and 4 mm.

4. The induction furnace according to claim 1, further comprising second cooling means formed on each winding of said electromagnetic induction means.

5. The induction furnace according to claim 4, wherein said second cooling means comprise a series of pipes carrying refrigerant to evacuate heat from said windings of said electromagnetic induction means.

6. The induction furnace according to claim 1, wherein said crucible has a diameter of between 300 and 400 mm.

7. An induction furnace comprising:

(a) a crucible having a plurality of metallic segments electrically insulated from each other, said crucible being open at a top portion to receive charge and substantially closed at a bottom portion to contain charge;

(b) cooling means provided on and arranged longitudinally along an outer surface of each said metallic segment;

(c) electromagnetic induction means arranged around said crucible, said electromagnetic induction means being energized by a high intensity, low frequency electric current;

(d) a discharge pipe located at the bottom of said crucible; and (e) second electromagnetic induction means arranged around and near said discharge pipe and energized by an intermediate frequency electric current, whereby melted charge flows from said crucible through said discharge pipe only when said second electromagnetic induction means is energized to melt a portion of said charge located within said discharge pipe thereby opening said discharge pipe to downward movement of melted material within said crucible.

8. The induction furnace according to claim 7, wherein said first electromagnetic induction means is energized from a secondary winding of a transformer, a primary winding of said transformer being directly connected to low frequency power mains.

9. The induction furnace according to claim 7, wherein said second electromagnetic induction means is energized by an electrical current having a frequency between 400 and 1000 Hz.

10. The induction furnace according to claim 7, further comprising cooling means connected to said discharge pipe.

* * * * *